US005822883A

United States Patent [19]

Horwitz

[11] Patent Number: 5,822,883

[45] Date of Patent: Oct. 20, 1998

[54] EXHAUST AIR PARTICULATE CONTAMINATION SENSING FOR TUMBLER DRYERS

[75] Inventor: Steven A. Horwitz, Bryan, Ohio

[73] Assignee: White Consolidated Industries, Inc., Cleveland, Ohio

[21] Appl. No.: 949,159

[22] Filed: Oct. 10, 1997

Related U.S. Application Data

[62] Division of Ser. No. 760,050, Dec. 4, 1996, Pat. No. 5,709,040.

[51] Int. Cl.[6] ..... F26B 3/00

[52] U.S. Cl. ..... 34/494; 34/495

[58] Field of Search ..... 34/425, 493, 494, 34/495, 499; 73/863.01, 863.34

[56] References Cited

U.S. PATENT DOCUMENTS

| | | | |
|---|---|---|---|
| 2,855,268 | 10/1958 | Goins et al. . | |
| 3,639,998 | 2/1972 | Mason | 34/82 |
| 3,718,982 | 3/1973 | Deaton . | |
| 3,859,842 | 1/1975 | Bosch . | |
| 3,922,905 | 12/1975 | Roth . | |
| 3,986,386 | 10/1976 | Beltzer et al. . | |
| 3,993,017 | 11/1976 | De Brey . | |
| 4,114,557 | 9/1978 | De Brey . | |
| 4,689,896 | 9/1987 | Narang | 34/82 |
| 4,700,492 | 10/1987 | Werner et al. . | |
| 5,050,313 | 9/1991 | Wakaeya et al. | 34/454 |
| 5,097,606 | 3/1992 | Harmelink et al. . | |
| 5,157,848 | 10/1992 | Dongelmans . | |
| 5,210,960 | 5/1993 | LaRue . | |
| 5,315,765 | 5/1994 | Holst et al. | 34/260 |
| 5,410,907 | 5/1995 | Strom et al. . | |
| 5,571,945 | 11/1996 | Koutrakis et al. | 34/28.03 |

*Primary Examiner*—Henry A. Bennett
*Assistant Examiner*—Steve Gravini
*Attorney, Agent, or Firm*—Pearne, Gordon, McCoy & Granger LLP

[57] ABSTRACT

A dryer system comprising a particle counter that measures the level of particulates in the dryer is disclosed. The dryer system is particularly adapted for drying garments to be worn in clean room environments. The dryer system preferably comprises an enclosure having a rotatable drum for receiving and tumbling garments or other clothing, a fan and motor assembly for providing airflow through the drum, an exhaust duct near the drum and in communication with the drum, a sampling tube in the exhaust duct, and a particle counter for measuring the concentration of particles withdrawn through the sampling tube from the drum. A sampling line may optionally be incorporated in the dryer inlet for withdrawing one or more samples of inlet air and transferring to the particle counter. A check may then be made to ensure that the incoming air is sufficiently clean. The present invention also provides methods of controlling the dryer by a control unit utilizing a signal from the particle counter representative of the measured concentration of particulates in the dryer exhaust.

2 Claims, 3 Drawing Sheets

EXHAUST AIR PARTICULATE CONTAMINATION SENSING FOR TUMBLER DRYERS

This is a divisional of application Ser. No. 08/760,050, filed Dec. 4, 1996 U.S. Pat. No. 5,709,040.

FIELD OF THE INVENTION

The present invention relates to a dryer comprising a particulate monitoring system. The invention is especially applicable for clothes dryers dedicated to drying garments to be worn in clean room environments.

BACKGROUND OF THE INVENTION

The manufacture of delicate and intricate microelectronic circuits and components typically requires a clean room environment. Persons working in such environments must wear protective body suits that prevent pollutants or contaminates from the person or person's clothing from becoming airborne. Once airborne, such pollutants can adversely affect such circuits or processes for their manufacture.

Although disposable clean room body suits are known, reusable, washable suits are generally preferred. The laundering of clean room garments presents particular challenges since upon laundering and drying, such garments must be relatively free of pollutants or contaminants. Typical pollutants include dust, lint, or other microparticles, which can readily become airborne in a clean room environment.

When laundering clean room garments, the current practice is to launder multiple batches of garments and measure the level of particulates of a small number of representative samples. Samples are generally taken of air which contacts the garments after laundering, such as during or subsequent to drying of the garments. Samples obtained during drying typically necessitate interrupting the drying cycle to withdraw samples for subsequent analysis. If a representative number of laundered samples meet the requisite cleanliness level, the collection of laundry batches is deemed acceptable. This practice requires a technician to determine how many samples need to be taken, withdraw the samples, analyze the particular samples, decide whether the garments are at a satisfactory level of cleanliness, and if not, continue the laundering or drying operation until such level is reached.

Although satisfactory in most respects, this practice is undesirable in view of the time and labor associated with the activities of the technician, the inevitable occurrence of some garments leaving the laundering facility having levels of particulates that exceed the maximum limit due to reliance upon only a sampling of laundered garments, and the additional costs resulting from overlaundering or cleaning some garments beyond the required cleanliness level since only a sampling of laundry batches are utilized to indicate the cleanliness level of an entire collection of laundry batches. Thus, it is desirable to provide a method and/or device that overcomes these disadvantages. Furthermore, it is desirable to provide an indication of the particulate level of every laundered batch, and thus, confirmation that each batch is at the requisite cleanliness level.

SUMMARY OF THE INVENTION

The present invention achieves all of the foregoing objectives and provides in one aspect, an apparatus for removing particulates from garments to a desired particulate level. The apparatus comprises a chamber for receiving the garments, and a particle counter assembly that includes a sample port in communication with the chamber.

In another aspect, the present invention provides an apparatus for removing particulate contaminants from garments to a predetermined level. The apparatus comprises enclosure and a rotatable drum, a fan and drive unit in association with the drum, an exhaust duct, a particle counter assembly having a sampling tube in communication with the exhaust duct, and provisions for providing a control output used for governing the operation of the apparatus.

In yet another aspect, the present invention provides a tumbler dryer comprising an enclosure having a rotatable drum for receiving and tumbling garments, a fan and motor assembly for providing airflow through the drum, an exhaust duct near the drum, a particle counter assembly having a sampling tube in the exhaust duct, the particle counter for measuring the concentration of particles in the sample, and a unit for producing an output signal indicating the concentration of particles in the sample.

The present invention also provides methods for controlling the operation of dryers and related devices to achieve a desired level of cleanliness for items such as garments, and in particular, for garments to be worn in clean room environments. In one method, the measured concentration of particulates in a sample of air having passed over garments in a dryer is compared to a desired particulate concentration value. If the measured concentration is less than or equal to the desired particulate concentration value, dryer operation is terminated, or indication occurs that the desired cleanliness level has been reached. If the measured concentration is greater than the desired particulate concentration value, then dryer operation is continued until the measured concentration is less than or equal to the desired concentration.

DESCRIPTION OF THE PREFERRED EMBODIMENTS

Figure 1:
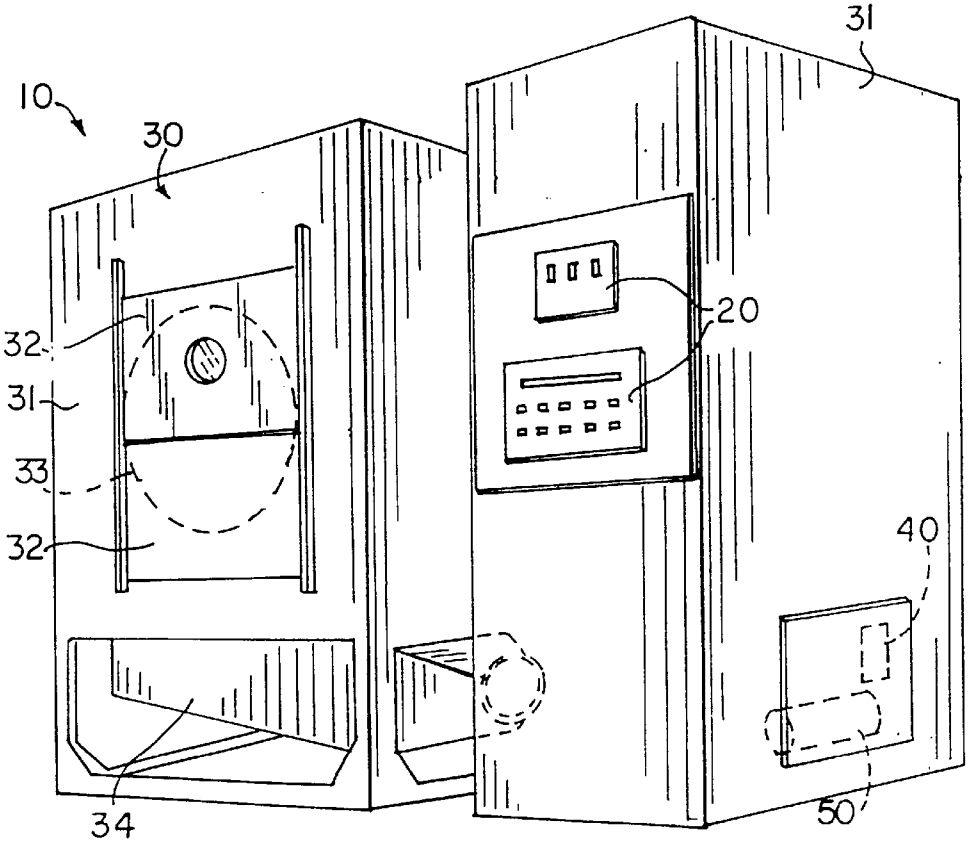
FIG. 1 is a perspective view of a preferred embodiment dryer system comprising a particulate measuring system in accordance with the present invention.

The present invention provides a dryer system comprising a particulate measuring device that monitors and/or governs dryer operation and enables the removal of particulate contaminants from garments to a predetermined level. Moreover, the dryer system of the present invention documents the initial and final levels of particulates in, associated with, or carried by garments and thus provides an accurate record that every laundered batch is at the requisite level of cleanliness. It will be understood that the terms "particle" and "particulate" are utilized interchangeably herein FIG. 1 illustrates a preferred embodiment dryer system 10 according to the present invention. The dryer system 10 comprises a dryer 30, most preferably a tumbler dryer, having one or more cabinets 31, one or more doors 32 providing access to an interior chamber, preferably a rotatable drying drum 33 for receiving and tumbling garments disposed therein, and a dryer exhaust duct 34 for directing dryer air from the drying drum 33. The dryer system 10 further comprises a dryer control unit 20 of the type known to those skilled in the art. The control unit 20 generally provides for setting dryer time periods and drying parameters. It is preferred that the control unit 20 comprises a storage or memory unit whereby one or more control parameters can be input and stored within the control unit 20. The dryer system 10 further comprises a particle counter device 40 and a measuring sample pump 50 described in greater detail below.

Figure 2:
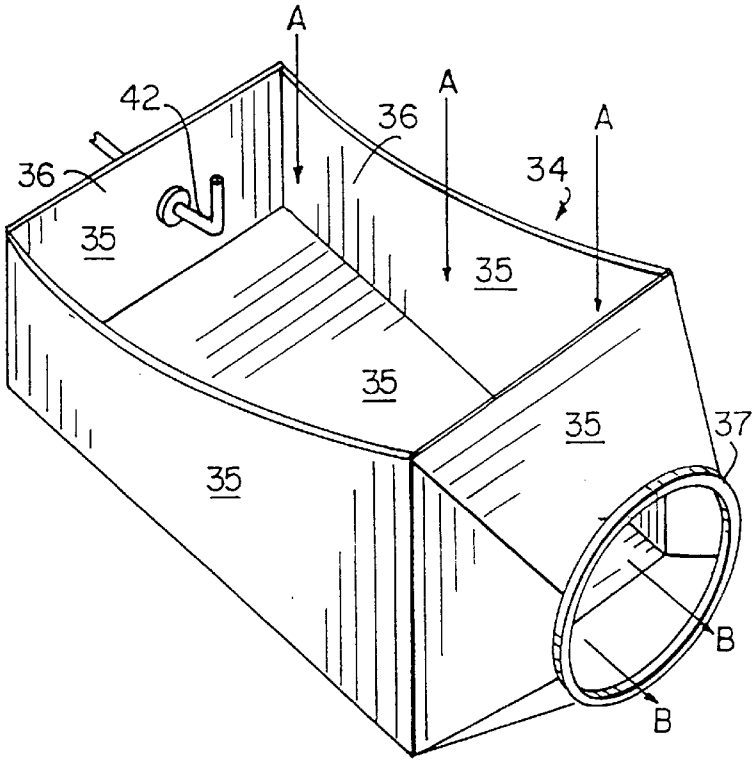
FIG. 2 is a perspective view of an exhaust duct from the preferred embodiment dryer system depicted in FIG. 1, illustrating a sampling line for the particulate measuring system in accordance with the present invention.

FIG. 2 is a perspective view of the dryer exhaust duct 34 typically located along the dryer underbody and below the drying drum 33. The dryer exhaust duct 34 comprises one or more walls or panels 35 configured to define an exhaust air inlet 36 and an exhaust air outlet 37. Although the dryer exhaust duct 34 illustrated in FIG. 2 is depicted as providing an upward facing exhaust air inlet 36 and laterally directed exhaust air outlet 37, other configurations are contemplated and encompassed within the present invention. When incorporated into the dryer 30, heated air exiting the drying drum 33 enters the dryer exhaust duct 34 through the exhaust air inlet 36 as shown in FIG. 2 by airflow lines A. The dryer exhaust duct 34 directs the heated exhaust air through the exhaust air outlet 37 as shown in FIG. 2 by airflow lines B. Disposed along a wall 35, preferably at a midpoint along the length of a wall opposite the exhaust air outlet 37, is a sampling line 42 for transferring a sample of the dryer exhaust air, e.g. airflow lines A, from the dryer exhaust duct 34 to the particle counter 40. The open end of the sampling line 42 is referred to herein as a sample port. It is most preferred that the end of the sampling line 42 or sample port is directed toward the dryer exhaust air entering the dryer exhaust duct 34 as illustrated in FIG. 2. Other locations and configurations for the end of the sampling line 42 besides that shown in FIG. 2 are contemplated. For instance, the sampling line 42 or its open end, could be disposed within the drying drum 33, or at some other component upstream of the dryer exhaust duct 34. Alternatively, the sampling line 42 or its open end, could be located at a component downstream of the dryer exhaust duct 34. The sampling end could also be located away from the dryer exhaust air.

Figure 3:
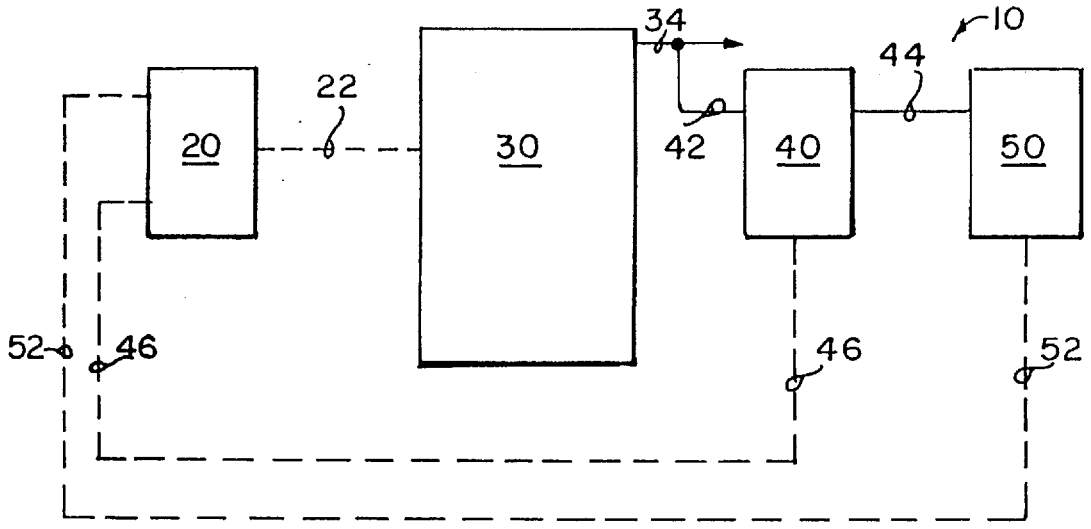
FIG. 3 is a schematic diagram illustrating the preferred embodiment dryer system.

FIG. 3 is a schematic of the preferred embodiment dryer system 10 according to the present invention. As noted, the dryer system 10 comprises the dryer control unit 20, the dryer 30, the particle counter device 40, and the measuring sample pump 50. Dryer operation is controlled by one or more analog or digital control signals 22 between the dryer control unit 20 and the dryer 30.

The particle counter 40 is configured with the dryer 30 so that an air sample is drawn from the exhaust duct 34 of the dryer 30 to the particle counter device 40 through the sampling line 42. Such sample transfer is preferably accomplished by providing the measuring sample pump 50 along a second sampling line 44 as illustrated in FIG. 3. Accordingly, operation of the measuring sample pump 50 draws air through the sampling lines 42 and 44 and thus into the particle counter device 40 whereby particulate level measurements are performed. The sampling lines 42 and 44 are preferably formed from 0.25" stainless steel tubing.

As further illustrated in FIG. 3, it is preferred that the particle counter device 40 provides an analog or digital output signal 46 representative of the level of particulates being measured. Such signal 46 is preferably directed to the dryer control unit 20 wherein it is utilized to control the operation of the dryer 30. In addition, it is preferred that the measuring sample pump 50 be remotely actuated through a switching signal 52 as noted in FIG. 3. Preferably, the dryer control unit 20 can initiate and terminate operation of the measuring sample pump 50 via the pump switching signal 52.

The particle counter 40 can be nearly any type of particle counter known to those skilled in the art. It is preferred to utilize a laser-based particle counter. The particle counter selected preferably has a sensitivity sufficient to measure the particulate levels in typical control rooms and microelectronic manufacturing and assembly facilities, and so should be operable at the expected use conditions. The particle counter 40 should be able to detect and measure the concentration of particles as small as about 0.5 microns. A preferred particle counter is available from MET-One, Part No. R 4915. Instead of utilizing an integral particle counter wherein an air sample is transferred to the particle counter and measurements and analytical analyses are conducted within a single instrument enclosure, it is also envisioned to utilize a component-based particle counter system. Such a system may utilize a sensor and/or counter device disposed near the location at which a sample is withdrawn and utilize separately located circuitry and other components for performing analytical functions. Furthermore, the present invention includes embodiments in which the particle counter device is disposed directly in the dryer exhaust duct or the drying chamber and the sampling tube is eliminated. In these embodiments not utilizing a sampling tube, the sample port may be directly incorporated with the particle counter device.

It is contemplated that a wide array of measuring sample pumps can be utilized for the pump 50 in the preferred embodiment dryer system 10 of the present invention. An example of a suitable pump is a vacuum pump available from Gast, Part No. 0323-101Q-G582 DX supplying 26 inches of suction at one cubic foot per minute. Other devices providing sufficient suction are suitable for use.

The present invention also includes an optional sampling configuration in which one or more samples of the air stream entering or directed to the dryer are taken, and the concentration of particulates measured. As previously noted, inlet air to a clean room dryer is extensively filtered. An additional check or safeguard against particulate contaminants collecting on clean room garments can be made by sampling the dryer inlet air before and during dryer operation. This optional sampling operation would identify a loss in airstream cleanliness, such as resulting from filter failure or leaks in the airways.

This optional sampling system comprises a sampling tube, such as the previously described sampling line 42, disposed either in the dryer air inlet, or in the inlet air passageway. The sampling tube is connected to a sample pump, such as the previously noted sample pump 50. The same sample pump 50 as is used in the preferred embodiment exhaust air sensing system may be used for withdrawing a sample of inlet air if appropriate valving is employed. An electrically operated solenoid valve and panel mounted switch may be used to select from which sampling line the sample pump 50 is to withdraw a sample, i.e. the sampling tube on the dryer air inlet or the sampling line 42 on the dryer exhaust. The samples are then transferred to the particle counter and measurements of the concentration of particulates made. If such an optional dryer air inlet sensing system is used, it is preferred that the particle counter employ provisions for producing an output representative of the amount of particulates in the inlet air.

The operation of the dryer and particle counter system in accordance with the present invention is generally as follows. Typically, upon placement of garments or other items to be dried in the dryer, e.g. the dryer drum, the dryer is activated and the drying operation begins. This typically involves directing heated air through the drying chamber. At some designated moment, either before, during, or after completion of the drying cycle, the particle counter system is actuated and measurements are taken of the concentration of particulates in the drying chamber or optionally, of air entering the dryer. The operation of the optional sampling of incoming air to the dryer is explained below. As noted, the particle counter can be activated at any time relative to the drying cycle. That is, the particle counter can be initiated and particulate measurements taken upon start-up and initiation of the drying cycle. Alternatively, the particle counter can be initiated at some point during the drying cycle before completion of the drying cycle. Alternatively, the particle counter can be activated at the time of drying cycle completion. It is also contemplated that the particle counter could be initiated at some point after the drying cycle has been completed.

Once actuated, measurements are taken of air samples withdrawn from the drying chamber, or of air having passed through the drying chamber. The measurements of particulate concentration in the air samples are compared to a setpoint value which typically is a predetermined value or a desired level of particulates. The setpoint value may either be stored by the particle counter system or the dryer controller, or input by an operator. If the measured level of particulates exceeds the setpoint value, the drying cycle, or at least passage of clean filtered air through the drying cycle, is continued. Periodic measurements are taken which are compared to the setpoint value. When the measured level of particulates is equal to or less than the setpoint value, a shut down procedure is performed. This may be carried out in conjunction with an indication of such condition. Recognition of reaching the setpoint value may be performed by other methods such as utilizing statistical sampling techniques or cumulative totalizing of measured particulate levels.

As noted, an optional sampling of the inlet air to the dryer may be made and analyzed by the particle counter. Such an operation is performed as follows. A sample of the dryer inlet air is taken, which if utilizing a single sampling pump, is performed by switching sampling lines to which the sampling pump is connected if necessary, so that the pump can withdraw from the inlet airstream. One or more samples of the inlet air are then taken and subsequent measurement made by the particle counter to confirm that the dryer inlet air is at an appropriate cleanliness level. One or more visual or audio indicators may be used to indicate that such condition has, or has not, been met.

Figure 4:
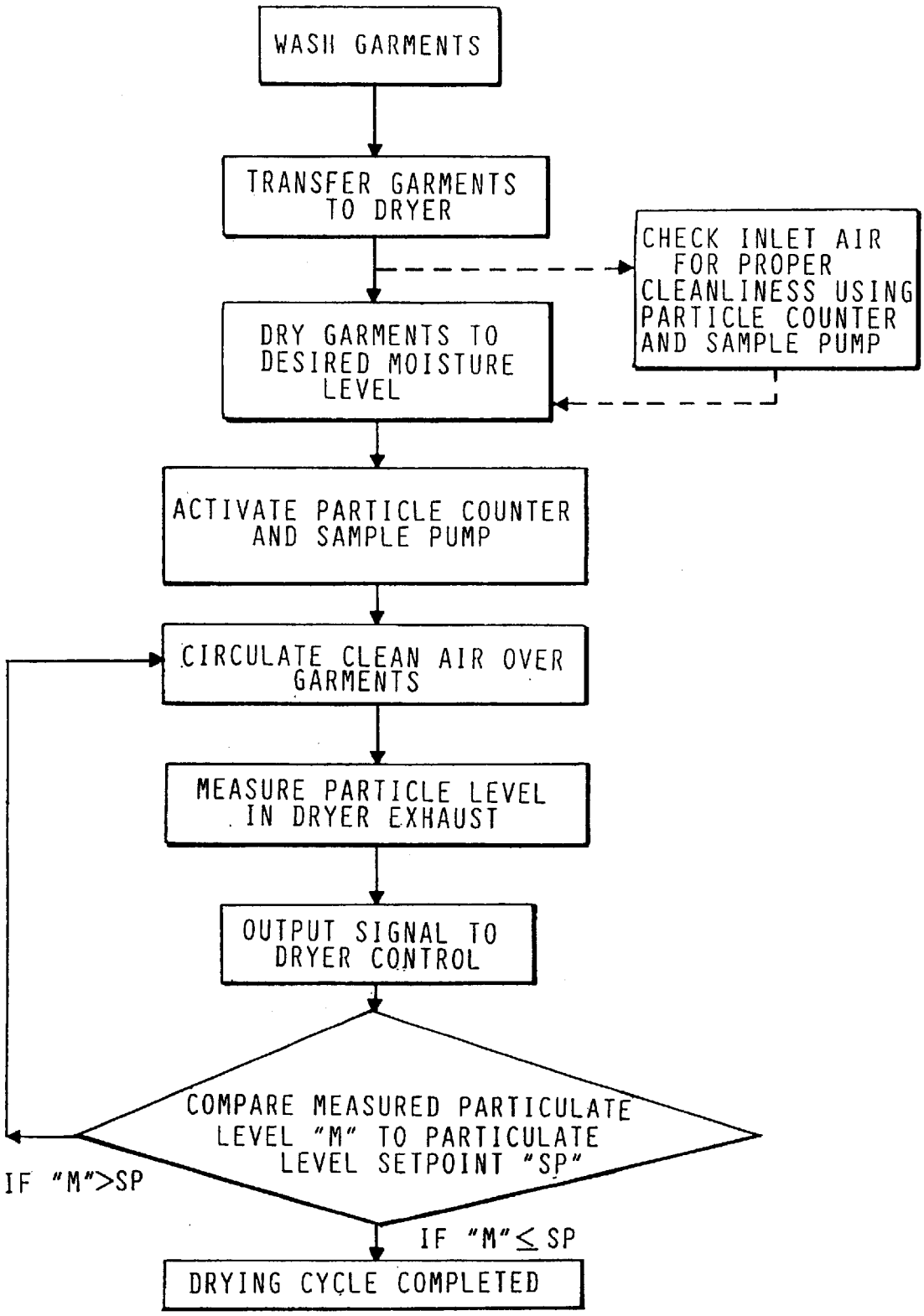
FIG. 4 is a block flow diagram illustrating the operation of the preferred embodiment dryer system.

FIG. 4 is a block flow diagram illustrating the preferred operation of the dryer system 10 according to the present invention. After garments, body suitsi or other clothing, such as for clean room application have been washed, the garments are transferred to the dryer system 10 of the present invention. The garments are then dried to a desired moisture level, i.e. such level typically being preset and monitored by controls known in the art. The previously described optional dryer inlet air particulate measurement operation may be performed before or during the dryer operation. Once the drying cycle has been completed, or the desired level of moisture reached indicating such dryness, an air tumble cycle is initiated in which clean filtered air is circulated over the garments in the dryer 30. If not already activated, such as from the optional dryer inlet air analysis, initiation of the air tumble cycle also preferably activates the particle counter 40 and the measuring sample pump 50. As clean filtered air is circulated over the garments, the measuring sample pump 50 withdraws a sample of dryer exhaust air from the exhaust air duct 34 through the sampling line 42 into the particle counter device 40. The particle counter 40 measures the particulate level in the dryer exhaust air and generates an output signal 46 to the dryer control unit 20. Previously or concurrently, the operator preferably enters the desired particulate level setpoint designated herein as "SP" into the dryer control unit 20 which is compared with the output signal from the particle counter device 40, designated herein as "M" and representative of the measured particulate level. If the measured particulate level M is greater than the previously entered or desired particulate level setpoint SP, circulation of clean air over the garments is continued and the circulation cycle is repeated. It may be desirable to provide an indication if this cycle is repeated an excessive number of times, such as more than five times. During the circulation of clean air over garments, the particle counter device 40 continues to measure the particulate level from the dryer exhaust 34 and generates a corresponding output signal 46 to the dryer control unit 20. Once the measured particulate level M is equal to or less than the particulate level setpoint SP, the dryer control unit 20 terminates the circulation cycle and provides a signal or indication that the drying cycle is completed.

Figure 5:
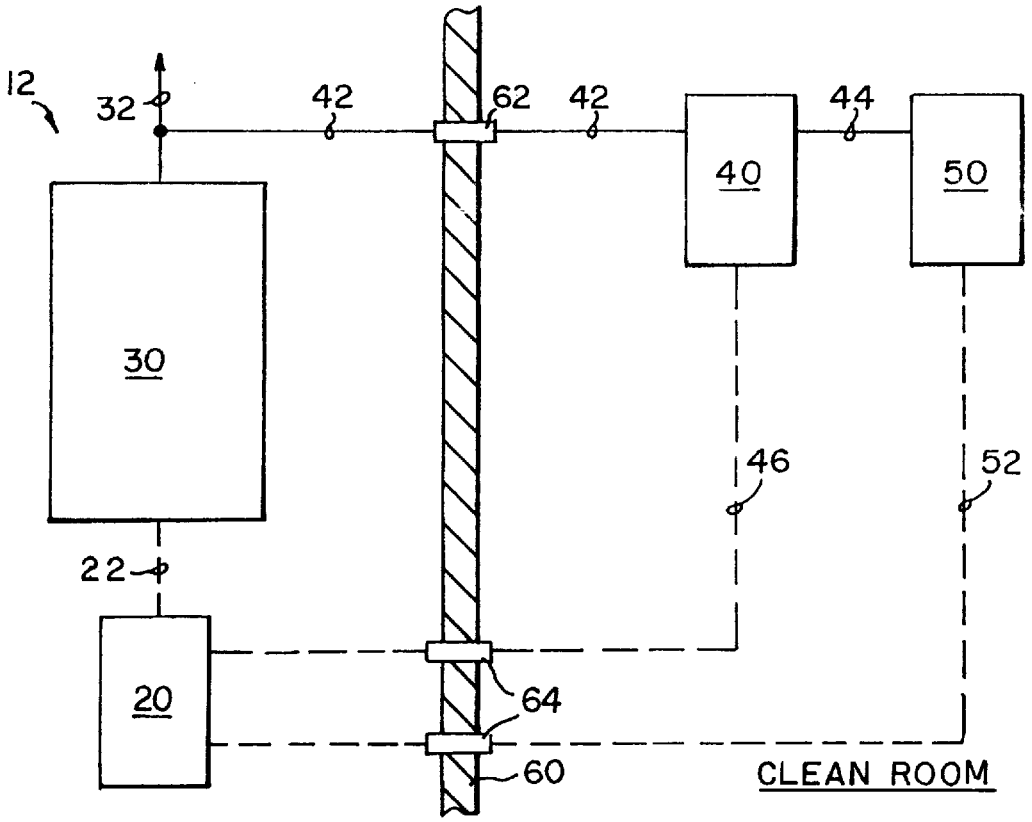
FIG. 5 is a schematic diagram illustrating a preferred alternate embodiment dryer system comprising a remotely located particle counter device.

In an alternate embodiment dryer system 12 illustrated in FIG. 5, the dryer system 12 comprises a dryer 30 and a control unit 20, and a remotely located particle counter 40 and sample pump 50. All components are generally as previously described. In this alternate embodiment, the particle counter 40 and sample pump 50 are located within a clean room or other similar facility. This alternate embodiment may be desirable for applications involving an existing clean room, already having particulate measuring instruments, retrofitted with a clean room garment laundry or drying area or device. In order to facilitate connection between the components, one or more sample line connectors or conduits 62, and one or more electrical connectors 64 can be utilized. Such connectors 62 and 64 are preferably installed in a clean room barrier wall 60, and prevent entry of pollutants into the clean room.

The present invention includes other configurations for remotely locating the particle counter 40 and supporting components, besides that illustrated in FIG. 5. For instance, the measuring sample pump 50 could be located in another area besides the clean room, and/or the control unit 20 could be located in the clean room.

In all of the foregoing embodiments, it may be necessary to provide one or more cooling means for the exhaust sampling line 42. Such means may include, but not limited to cooling coils, one or more heat exchangers, and cooling devices such as refrigerators. Many manufacturers and suppliers of particle counter devices recommend that the units not be exposed to temperatures greater than 80° F. or receive air samples having temperatures greater than 80° F. Since the temperature of dryer exhaust air is typically greater than 80° F., it will in most instances be necessary to cool the air sample before directing it to the particle counter.

Moreover, the present invention includes the use of multiple or redundant components including particle counters 40. For instance, a dryer system similar to the previously described dryer systems 10 and 12 could utilize a plurality of particle counters 40. The output signals 46 from each could be averaged or otherwise treated for subsequent controlling and indicating functions. Additionally, the use of multiple sample ports are contemplated such as one or more disposed within a drying drum and/or one or more within a dryer exhaust duct.

Although the present invention has been described primarily in terms of a tumbler dryer, it is to be understood that the present invention may be embodied in other types of dryers. Furthermore, it is to be understood that the invention includes devices in addition to dryers, or devices that supply a stream of air or other gases over items to be dried.

While the foregoing details are what is felt to be the preferred embodiments of the invention, no material limitations to the scope of the claimed invention is intended. Further, features and design alternatives that would be obvious to one of ordinary skill in the art are considered to be incorporated herein. The scope of the invention is set forth and particularly described in the claims hereinbelow.

What is claimed is:

1. A method for controlling the operation of a tumbler dryer to achieve a desired concentration of particulates associated with garments disposed in said dryer, said dryer comprising a rotatable drum for receiving said garments, a particle counter in communication with said drum, provisions for passing air through said drum, and a control unit having data storage provisions enabling one or more control parameters to be input and stored by said control unit, said method comprising:

placing said garments in said drum;

designating a first signal in said control unit representative of a desired concentration of particulates associated with said garments;

passing air through said drum and over said garments;

measuring concentration of particulates in said air by use of said particle counter;

generating a second signal representative of the measured particulate concentration;

comparing said second signal representing measured concentration of particulates in said air with said first signal representing desired particulate concentration; and determining if said second signal is greater than said first signal and if so, then repeating at least said passing air step, and if not, then initiating a shut down sequence.

2. The method of claim 1 wherein said shut down sequence comprises at least one of the following steps: ceasing passing air through said drum, and indicating desired level of particulates has been reached.

* * * * *

UNITED STATES PATENT AND TRADEMARK OFFICE

CERTIFICATE OF CORRECTION

PATENT NO. : 5,822,883

DATED : October 20, 1998

INVENTOR(S) : Horwitz

It is certified that error appears in the above-identified patent and that said Letters Patent is hereby corrected as shown below:

On title page, References Cited, U.S. PATENT DOCUMENTS, insert --4,239,831 12/1980 Pattenden--.

On title page, after References Cited, U.S. PATENT DOCUMENTS, insert --FOREIGN DOCUMENTS, 995,100 8/1976 Canada--.

Column 2, line 6, before "enclosure", insert --an--.

Column 2, line 64, delete "herein" and insert --herein.--.

Signed and Sealed this

Fourth Day of May, 1999

*Attest:*

*Attesting Officer*

Q. TODD DICKINSON

*Acting Commissioner of Patents and Trademarks*